US009296084B2

(12) United States Patent
Zhang et al.

(10) Patent No.: US 9,296,084 B2
(45) Date of Patent: Mar. 29, 2016

(54) POLISHING CONTROL USING WEIGHTING WITH DEFAULT SEQUENCE

(75) Inventors: Jimin Zhang, San Jose, CA (US); Zhihong Wang, Santa Clara, CA (US); Harry Q. Lee, Los Altos, CA (US); Wen-Chiang Tu, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 908 days.

(21) Appl. No.: 13/553,038

(22) Filed: Jul. 19, 2012

(65) Prior Publication Data

US 2014/0024292 A1 Jan. 23, 2014

(51) Int. Cl.

*B24B 37/013* (2012.01)
*B24B 37/10* (2012.01)
*B24B 49/12* (2006.01)

(52) U.S. Cl.

CPC ..... *B24B 37/013* (2013.01); *B24B 37/105* (2013.01); *B24B 49/12* (2013.01)

(58) Field of Classification Search

CPC .... B24B 37/013; B24B 37/105; B24B 49/12; H01L 21/302; H01L 21/00; G01N 21/00; G06F 19/00

USPC ..... 451/5, 6, 11, 41, 285–290; 700/164

See application file for complete search history.

(56) References Cited

U.S. PATENT DOCUMENTS 6,491,569 B2 12/2002 Bibby, Jr.
8,369,978 B2 * 2/2013 David ..... B24B 7/005 356/630
8,657,646 B2 * 2/2014 Benvegnu ..... B24B 37/013 451/41
8,892,568 B2 * 11/2014 David ..... H01L 22/12 438/16
8,944,884 B2 * 2/2015 David ..... B24B 37/013 451/11
8,954,186 B2 * 2/2015 Qian ..... 438/692
8,977,379 B2 * 3/2015 David ..... 700/121
2002/0155788 A1 * 10/2002 Bibby, Jr. ..... B24B 37/013 451/6
2007/0042675 A1 2/2007 Benvegnu et al.
2007/0224915 A1 9/2007 David et al.
2008/0146120 A1 * 6/2008 Ravid ..... G01B 11/0683 451/6
2010/0056023 A1 3/2010 David et al.
2010/0103422 A1 * 4/2010 David ..... B24B 37/013 356/388
2010/0114532 A1 5/2010 David et al.
2011/0256805 A1 * 10/2011 David ..... B24B 37/013 451/5
2011/0281501 A1 * 11/2011 Qian ..... B24B 49/12 451/5
2011/0301847 A1 * 12/2011 David ..... B24B 37/013 702/2
2012/0028813 A1 * 2/2012 Qian ..... G05B 23/0208 506/2
2012/0276814 A1 * 11/2012 Zhang ..... B24B 7/013 451/5
2013/0052916 A1 * 2/2013 David ..... B24B 37/013 451/5
2013/0280989 A1 * 10/2013 Lee ..... B24B 37/013 451/5
2014/0024293 A1 * 1/2014 Zhang ..... B24B 49/10 451/5

* cited by examiner

*Primary Examiner* — George Nguyen
(74) *Attorney, Agent, or Firm* — Fish & Richardson P.C.

(57) ABSTRACT

A method of controlling polishing includes storing a sequence of default values, polishing a substrate, monitoring the substrate during polishing with an in-situ monitoring system, generating a sequence of measured values from measurements from the in-situ monitoring system, combining the sequence of measured values with the sequence of default values to generate a sequence of modified values, fitting a function to the sequence of modified values, and determining at least one of a polishing endpoint or an adjustment for a polishing rate based on the function.

18 Claims, 4 Drawing Sheets

POLISHING CONTROL USING WEIGHTING WITH DEFAULT SEQUENCE

TECHNICAL FIELD

The present disclosure relates generally to monitoring of a substrate during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad with a durable roughened surface. The carrier head provides a controllable load on the substrate to push it against the polishing pad. A polishing liquid, such as a slurry with abrasive particles, is typically supplied to the surface of the polishing pad.

One problem in CMP is using an appropriate polishing rate to achieve a desirable profile, e.g., a substrate layer that has been planarized to a desired flatness or thickness, or a desired amount of material has been removed. Variations in the initial thickness of a substrate layer, the slurry composition, the polishing pad condition, the relative speed between the polishing pad and a substrate, and the load on a substrate can cause variations in the material removal rate across a substrate, and from substrate to substrate. These variations cause variations in the time needed to reach the polishing endpoint and the amount removed. Therefore, determining the polishing endpoint merely as a function of the polishing time may lead to overpolishing or underpolishing, and it may not be possible to achieve a desired profile merely by applying a constant pressure.

In some systems, a substrate is monitored in-situ during polishing. A variety of monitoring techniques have been used, such as spectrographic and eddy current. However, existing monitoring techniques may not satisfy increasing demands of semiconductor device manufacturers.

SUMMARY

In some in-situ monitoring processes, a sequence of values is generated from measurements from a substrate. In order to determine the polishing endpoint, a function can be fit to the sequence of values, and the time at which the function equals a target value is used as the polishing endpoint. However, the values may not reliably indicate the status of the polishing operation. Also, generating values that reliably indicate the status of the polishing operation may be computationally prohibitive, e.g., if a measured spectrum is to be compared to large number of reference spectra. In order to compensate for less reliable values from the in-situ monitoring system, the measured sequence of values can be combined with a default sequence of values to generate a modified sequence of values. A function can be fit to the modified sequence of values, and the time at which the function equals a target value can be used as the polishing endpoint.

In one aspect, a method of controlling polishing includes storing a sequence of default values, polishing a substrate, monitoring the substrate during polishing with an in-situ monitoring system, generating a sequence of measured values from measurements from the in-situ monitoring system, combining the sequence of measured values with the sequence of default values to generate a sequence of modified values, fitting a function to the sequence of modified values, and determining at least one of a polishing endpoint or an adjustment for a polishing rate based on the function.

Implementations can include one or more of the following features. For each measured value from the sequence of measured values there may be an associated default value from the sequence of default values. Combining the sequence of measured values with the sequence of default values may include, for each measured value, calculating a weighted average of the measured value and the associated default value. A first timestamp may be stored for each measured value from the sequence of measured values, and a second timestamp may be stored for each default value from the sequence of default values. A matching default value from the sequence of default values may be determined for each measured value, and determining the matching default value may include determining a second timestamp that matches the first timestamp. The first timestamp may be a measurement time, a number of platen rotations, or an ordinal position in the sequence of measured values. User input may be received selecting the weighting value for the calculation of the weighted average. A same weighting value may be used for the calculation of the weighted average for every measured value from the sequence of measured values. A weighting value may be dynamically determined for the calculation of the weighted average. Dynamically determining the weighting value may include fitting a second function to the sequence of measured values, determining a goodness of fit of the second function to the sequence of measured values, and determining the weighting value based on the goodness of fit. Monitoring the substrate may include receiving a measured spectrum from the in-situ monitoring system, and generating the sequence of measured values may include finding a best matching reference spectrum from a plurality of references spectra. Dynamically determining the weighting value may include determining a difference between the measured spectrum and the best matching reference spectrum, and determining the weighting value based on the difference. A weighting value may be calculated for each measured value. The in-situ monitoring may include an optical monitoring system or an eddy current monitoring system. Polishing the substrate may include rotating a platen, and the sequence of measured values may include one measured value per rotation of the platen. A target value may be stored and a polishing endpoint may be determined by calculating a time at which the function equals the target value. A value of the function at a time T0 at which the polishing parameter is adjusted may be determined, and determining the adjustment may include calculating a desired polishing rate based on the value of the function.

In other aspects, polishing systems and computer-program products tangibly embodied on a computer readable medium are provided to carry out these methods.

Certain implementations may have one or more of the following advantages. Reliability of the endpoint system to detect a desired polishing endpoint can be improved, and within-wafer and wafer-to-wafer thickness non-uniformity (WIWNU and WTWNU) can be reduced. For spectrographic monitoring, a measured spectrum can be compared to fewer reference spectra to generate the sequence of values, reducing computational load.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
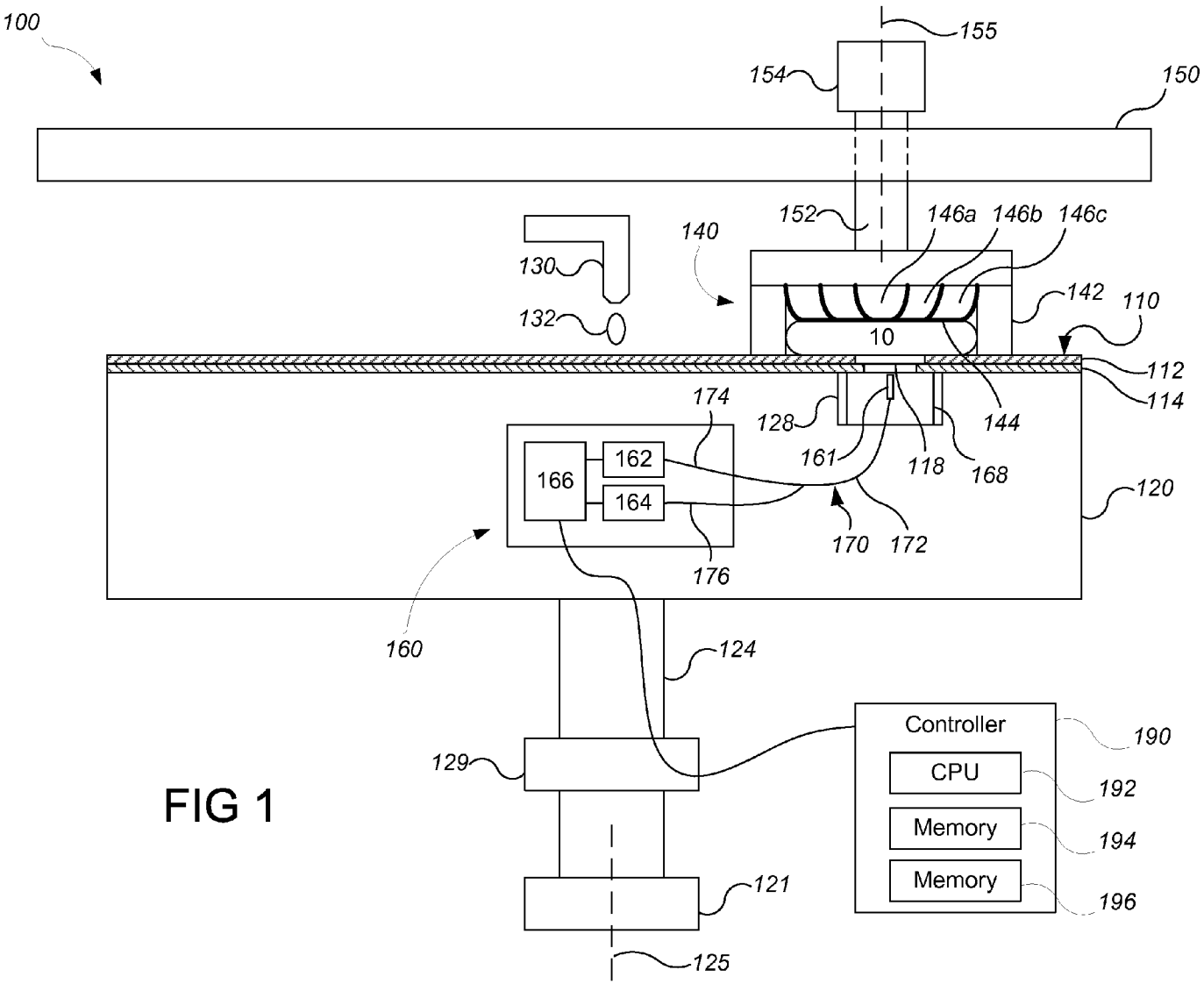
FIG. 1 illustrates a schematic cross-sectional view of an example of a polishing apparatus having two polishing heads.

FIG. 1 illustrates an example of a polishing apparatus 100 for polishing one or more substrates 10. The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. In particular, the carrier head 140 can include a retaining ring 142 to retain the substrate 10 below a flexible membrane 144. The carrier head 140 also includes a plurality of independently controllable pressurizable chambers defined by the membrane, e.g., three chambers **146*a*-146*c*, which can apply independently controllable pressurizes to associated zones on the flexible membrane 144 and thus on the substrate 10. Although only three chambers are illustrated in FIG. 1** for ease of illustration, there could be one chamber, two chambers, or four or more chambers, e.g., five chambers.

Each carrier head 140 is suspended from a support structure 150, e.g., a carousel or track, and is connected by a drive shaft 152 to a carrier head rotation motor 154 so that the carrier head can rotate about an axis 155. Optionally each carrier head 140 can oscillate laterally, e.g., on sliders on the carousel or track 150, or by rotational oscillation of the carousel itself. In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently.

The polishing apparatus also includes an in-situ monitoring system 160, which can be used to determine a pointing endpoint, or to determine whether to adjust a polishing rate or an adjustment for the polishing rate, as discussed below. The in-situ monitoring system generates a time-varying sequence of measured values that depend on the thickness of a layer on the substrate.

For example, the in-situ-monitoring system 160 can be an optical monitoring system. In particular, the in-situ-monitoring system 160 can be an optical monitoring system that measures a sequence of spectra of light reflected from a substrate during polishing and generates a sequence of measured values based on the sequence of spectra. One monitoring technique is, for each measured spectrum, to identify a best matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for each best matching reference spectrum, a time-varying sequence of measured characterizing values can be generated. This technique is described in U.S. Patent Publication No. 2010-0217430, which is incorporated by reference. Another monitoring technique is to track a characteristic of a spectral feature from the measured spectra, e.g., a wavelength or width of a peak or valley in the measured spectra. The wavelength or width values of the feature from the measured spectra provide the time-varying sequence of measured wavelength or width values. This technique is described in U.S. Patent Publication No. 2011-0256805, which is incorporated by reference. Another monitoring technique is to fit an optical model to each measured spectrum from the sequence of measured spectra. In particular, a parameter of the optical model is optimized to provide the best fit of the model to the measured spectrum. The parameter value generated for each measured spectrum generates a time-varying sequence of measured parameter values. This technique is described in U.S. Patent Application No. 61/608,284, filed Mar. 8, 2012, which is incorporated by reference. Another monitoring technique is to perform a Fourier transform of each measured spectrum to generate a sequence of transformed spectra. A position of one of the peaks from the transformed spectrum is measured. The position value generated for each measured spectrum generates a time-varying sequence of measured position values. This technique is described in U.S. patent application Ser. No. 13/454,002, filed Apr. 23, 2012, which is incorporated by reference.

Other examples of the in-situ-monitoring system 160 include eddy current monitoring systems, capacitive measurement systems, and slurry chemistry monitoring systems. For example, in the case of an eddy current monitoring system, the signal strength from the eddy current monitoring system can be sampled. The signal strength generated for each sampling time generates a time-varying sequence of measured eddy current signal strength values. Eddy current monitoring systems are described in U.S. Pat. No. 6,924,641 and U.S. Pat. No. 7,112,960, each of which is incorporated by reference.

Figure 2:
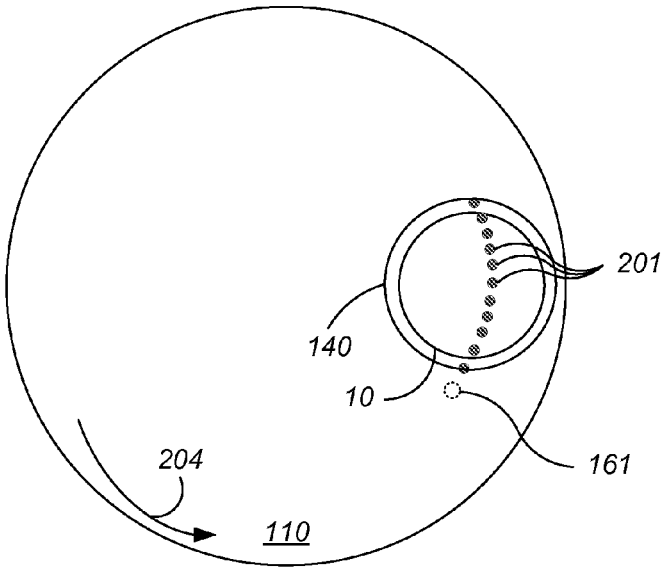
FIG. 2 illustrates a top view of a polishing pad and shows locations where in-situ measurements are taken on a first substrate.

In some implementations, the in-situ monitoring system 160 includes a probe 161 that is supported by and rotates with the platen 120. In this case, the motion of the platen will cause the probe 161 to scan across each substrate. As shown in FIG. 2, due to the rotation of the platen (shown by arrow 204), as the probe 161 travels below the first carrier head 140, the in-situ monitoring system 160 can make measurements at positions 201 below the substrate 10. This permits the in-situ monitoring system 160 to generate a signal with a value that depends on the thickness of the layer of the substrate 10.

The measurements can be converted by the-situ monitoring system 160 into a sequence of values. For example, for a rotating platen, one value can be added to the sequence per rotation of the platen. It is possible for multiple measurements to be obtained by the in-situ monitoring system 160 as the probe 161 passes below the substrate 10, in which case one of the obtained raw measurements can be selected, or multiple raw measurements can be combined, e.g., averaged, in determining the value.

In the case of an optical monitoring system, an optical access 118 through the polishing pad can be provided by including an aperture (i.e., a hole that runs through the pad) or a solid window. The solid window can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber an include a trunk 172 positioned in proximity to the optical access, and two branches 174 and 176 connected to the light source 162 and detector 164, respectively. The end of the trunk provides the probe 161 of the optical monitoring system 160.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

In the case of a spectrographic monitoring system, the light source 162 can be operable to emit visible light and/or near-infrared (NIR) light. In some implementations, the visible light emitted includes light having wavelengths of 200 to 800 nm. In some implementations, the NIR light emitted includes light having wavelengths of 0.9 to 1.7 μm.

Figure 3:
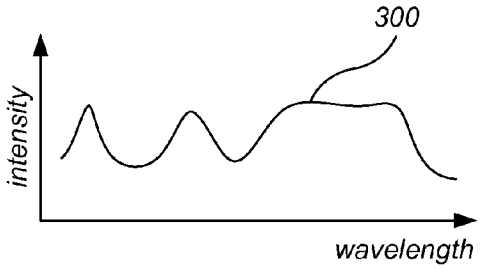
FIG. 3 illustrates a measured spectrum from the in-situ optical monitoring system.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 3 illustrates an example of a measured spectrum 300 with intensity as a function of wavelength.

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

Due to the rotation of the platen, the optical monitoring system 160 can measure raw spectra at multiple positions 201 below the substrate 10. To provide one measured spectrum per rotation, one of the raw spectra can be selected, or multiple raw spectra can be combined, e.g., averaged, to determine the measured spectrum.

Where multi-zone control is desired, for any given rotation of the platen, based on timing, motor encoder and/or platen position sensor information, the controller 190 can determine a radial position on the substrate where the measurement is made. Over multiple rotations of the platen, for each radial zone on the substrate, a sequence of values can be obtained over time.

Figure 4:
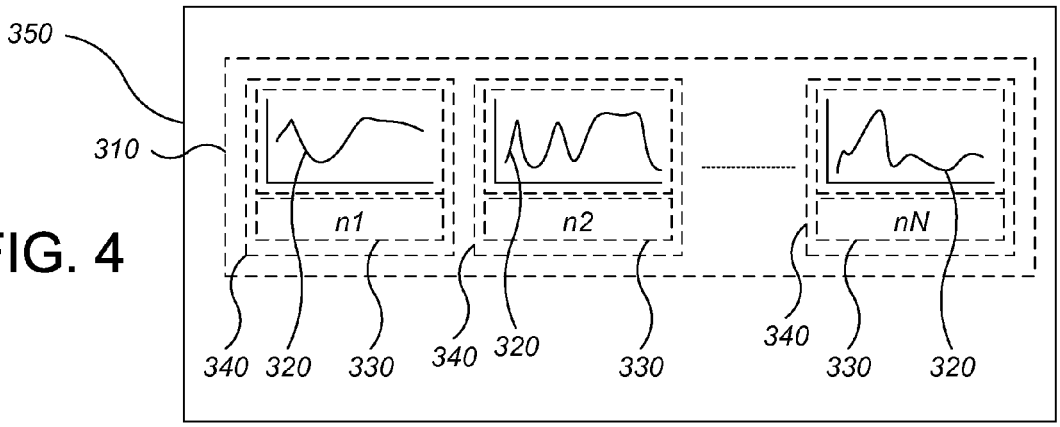
FIG. 4 illustrates a library of reference spectra.

Still referring to the case of a spectrographic monitoring system, referring to FIGS. 3 and 4, during polishing, a measured spectrum 300 (see FIG. 3) can be compared to reference spectra 320 from one or more libraries 310 of reference spectra (see FIG. 4).

Reference spectra 320 for a library 310 can be generated by polishing a "set-up" substrate, and collecting spectra as discussed above. The spectra from the set-up substrate can provide the library. Alternatively, the reference spectra can be generated from an optical model.

In some implementations, each reference spectrum 320 is assigned an index value 330. In general, the library 310 can include many reference spectra 320, e.g., one or more, e.g., exactly one, reference spectra for each platen rotation over the expected polishing time of the substrate. This index 330 can be the value, e.g., a number, representing the time in the polishing process at which the reference spectrum 320 is expected to be observed. The spectra can be indexed so that each spectrum in a particular library has a unique index value. The indexing can be implemented so that the index values are sequenced in an order in which the spectra were measured. An index value can be selected to change monotonically, e.g., increase or decrease, as polishing progresses. In particular, the index values of the reference spectra can be selected so that they form a linear function of time or number of platen rotations (assuming that the polishing rate follows that of the model or test substrate used to generate the reference spectra in the library). For example, the index value can be proportional, e.g., equal, to a number of platen rotations at which the reference spectra was measured for the test substrate or would appear in the optical model. Thus, each index value can be a whole number. The index number can represent the expected platen rotation at which the associated spectrum would appear.

The reference spectra and their associated index values can be stored in a reference library. For example, each reference spectrum 320 and its associated index value 330 can be stored in a record 340 of database 350. The database 350 of reference libraries of reference spectra can be implemented in memory of the computing device of the polishing apparatus.

Alternatively, each reference spectrum 320 can be assigned a thickness value rather than an index value 330. In addition, there can be multiple libraries, and the measured spectrum can be compared to the reference spectra from one or more of the libraries.

Figure 5:
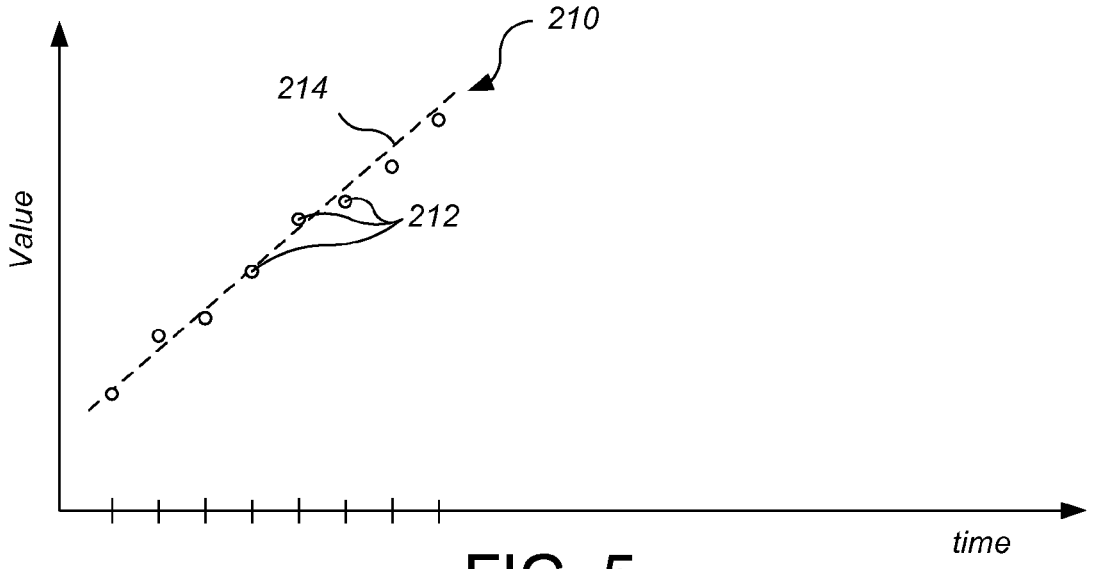
FIG. 5 illustrates a measured sequence of values.

Referring to FIG. 5, which illustrates the results for only a single substrate, a time-varying sequence 210 of measured values 212 is illustrated. This sequence of measured values can be termed a trace. In general, for a polishing system with a rotating platen, the trace 210 can include one, e.g., exactly one, measured value per sweep of the sensor below the substrate. If multiple zones on a substrate are being monitored, then there can be one measured value per sweep. As noted above, multiple measurements below the substrate can be combined to generate a single measured value that is used for control of the endpoint and/or pressure. However, it is also possible for more than one measured value to be generated per sweep of the sensor 162, e.g., if multiple sensors are installed in the platen.

In some implementations, a function, e.g., a polynomial function of known order, e.g., a line, can be fit to the sequence 210 of measured values 212, e.g., using robust line fitting. For example, a line 214 can be fit to the measured values 212 for the substrate. Fitting of a line to the sequence of values can include calculation of the slope S of the line and an x-axis intersection time T at which the line crosses a starting value, e.g., 0.

Figure 6:
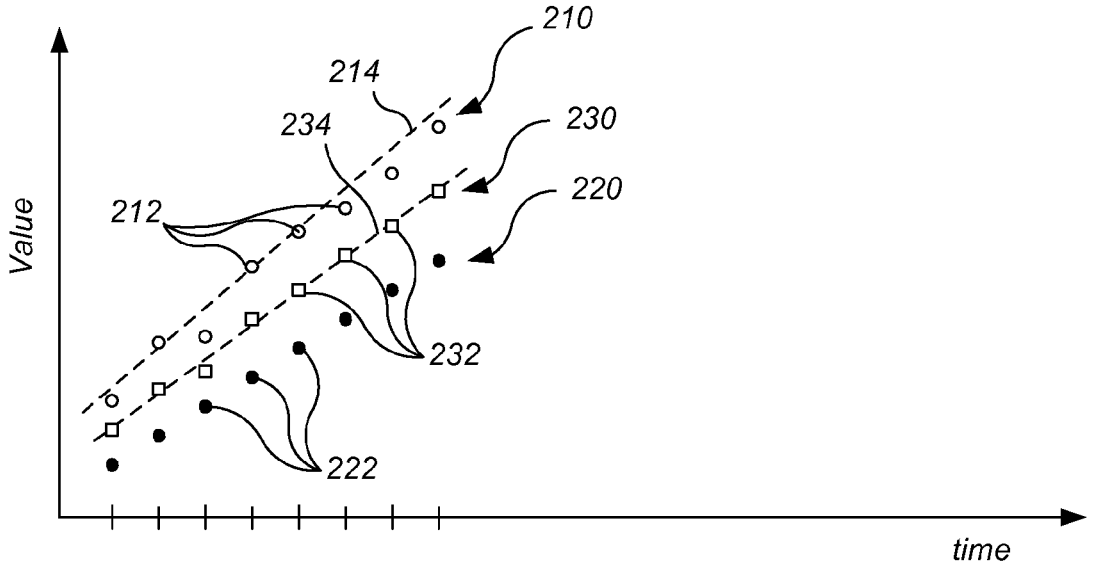
FIG. 6 illustrates a measured sequence of values and a default sequence of values.

Referring to FIG. 6, the controller 190 stores a sequence 220 of default values 222. The sequence 220 can have the same sampling frequency as the sequence 210 of measured values 212. Thus for each measured value 212, there is an associated default value 222, e.g., a one-to-one association.

Each measured value 212 can have an associated time stamp, e.g., an actual time of measurement, an ordinal position in the sequence, or a number of platen rotations at which the measured value was generated. Each default value 222 also has an associated time stamp. The default value 222 having an associated time stamp that matches the time stamp of the measured value 212 provides the associated default value.

The default values 222 can be received from a process control module. For example, the default values can be calculated under an assumption of a previously measured (i.e., before polishing of the present substrate) polishing rate or a default polishing rate. The default values can be calculated based on in-line measurement of the pre-polish thickness of the substrate.

The sequence 210 of measured values 212 is combined with the sequence 220 of default values 222 to generate a sequence 230 of modified values 232. A modified value 232 can be calculated for each measured value 212, so that there is an associated modified value 232, e.g., a one-to-one association, with each measured value 212. Each modified value 232 can be a weighted average of a measured value 212 and the associated default value 222. For example, for the value in the sequence 230, the modified value $V_I$ can be calculated as $$V_I = W_I * MV_I + (1 - W_I) * DV_I \quad (1)$$

where $MV_I$ is the measured value 212 in the sequence 210, $DV_I$ is the default value 222 in the sequence 220, and $W_I$ is a weighting value.

In some implementations, the same weighting value is used for the computation of all the modified values 232. Thus, the modified value $V_I$ can be calculated as $$V_I = W * MV_I + (1 - W) * DV_L \quad (2)$$

For this example, if W is equal to 0, then the data from in-situ monitoring system is not used and the polishing endpoint is controlled by the default values. On the other hand, if W is equal to 1, then the default values are not used and the polishing endpoint is controlled by the in-situ monitoring system. Typically however, the weighting value W will be greater than 0 and less than 1.

In some implementations, the weighting value is set by input from the semiconductor manufacturer. The semiconductor manufacturer can set the weighting value based on particular substrate patterns and polishing conditions.

In some implementations, the weighting value is set dynamically by the controller 190. For example, a goodness of fit of the function 214 to the measured values 212 can be calculated. The better the goodness of fit, the greater the weight given to the measured values 212. On the other hand, the worse the goodness of fit, the greater the weight given to the default values 222. Thus, for the example of the equation 2, better the goodness of fit, the closer W will be to 0. An advantage of this approach is that where the monitoring system is operating properly, the endpoint will be determined based on the data from the monitoring system, whereas if the data from the monitoring system is not reliable, then the system will tend to polish for a default time.

As another example, where the measured value is generated by finding a best matching reference spectrum from a plurality of reference spectra, a difference can be calculated for each measured spectrum and the best matching reference spectrum. The difference can be calculated using sum of squared differences or sum of absolute differences over the spectrum. The differences can be accumulated, e.g., a running average of differences can be calculated. The lower the cumulative difference, the greater the weight given to the measured values 212. On the other hand, the greater the cumulative difference, the greater the weight given to the default values 222. Thus, for the example of the equation 2, the lower the cumulative difference, the closer W will be to 0.

In some implementations, a weighting value $W_I$ weighting value can be calculated for each measured value.

For example, where the measured value is generated by finding a best matching reference spectrum from a plurality of reference spectra, a difference can be calculated between the measured spectrum and the best matching reference spectrum. The difference can be calculated using sum of squared differences or sum of absolute differences over the spectrum. The difference is then used to set the weighting value $W_I$ for the calculation of the associated modified value $V_I$. The lower the difference, the greater the weight given to the measured value 212. On the other hand, the greater the difference, the greater the weight given to the default value 222. Thus, for the example of the equation 1, the lower the difference, the closer $W_I$ will be to 0. An advantage of this approach is that individual measured spectra that are not reliable have less effect on the overall endpoint and control process.

A function, e.g., a polynomial function of known order, e.g., a line, can be fit to the sequence of 230 of modified values 232, e.g., using robust line fitting. For example, a line 234 can be fit to the modified values 232. Fitting of a line to the sequence of modified values can include calculation of the slope S1 of the line and an x-axis intersection time T1 at which the line crosses a starting value, e.g., 0.

Figure 7:
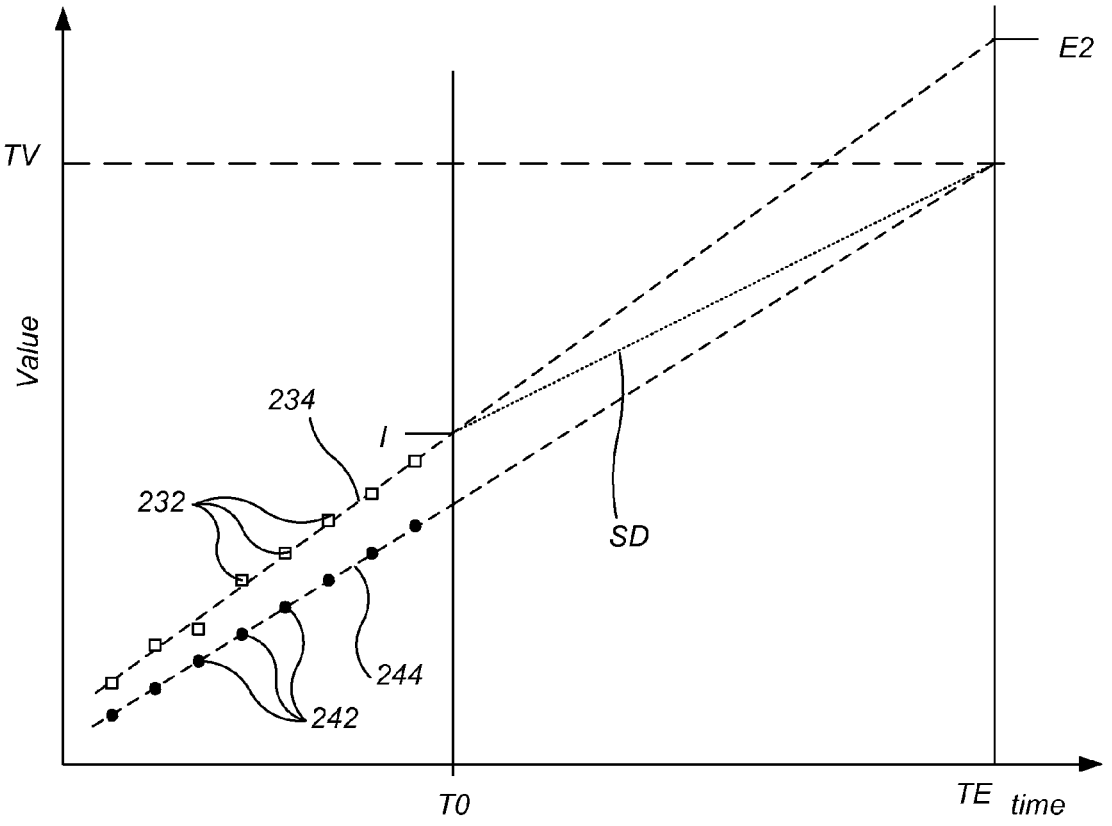
FIG. 7 illustrates a calculation of a desired slope for a substrate based on a time that a function fit to a sequence of modified values reaches a target value.

Referring to FIG. 7, in some implementations, at some point during the polishing process, e.g., at a time T0, a polishing parameter is adjusted based on the function 234. For example, the polishing rate can be adjusted so that at an expected endpoint time TE the value is closer to a target value TV. The expected endpoint time TE could be calculated from a function 244 fit to modified values 242 from another zone or another substrate, or could be the expected endpoint time TE of the sequence of default values 222. The expected endpoint time TE can be calculated as a simple linear interpolation of the line 244 to the target value TV, e.g., TV=S2·(TE−T2) where S2 is the slope of line 244 and T2 is the x-axis intersection time at which the line 244 crosses the starting value, e.g., 0.

A desired slope SD can be calculated from (V−I)=SD*(TE−T0), where I is the value (calculated from the linear function fit to the sequence of modified values) at time T0 polishing parameter is to be changed, TV is the target value, and TE is the calculated expected endpoint time.

The polishing rate is adjusted to bring the slope of the trace closer to the desired slope. The polishing rates can be adjusted by, for example, increasing or decreasing the pressure in a corresponding chamber of a carrier head. The change in polishing rate can be assumed to be directly proportional to the change in pressure, e.g., a simple Prestonian model. For example, for each substrate, where the substrate was polished with a pressure Pold prior to the time T0, a new pressure Pnew to apply after time T0 can be calculated as Pnew=Pold*(SD/S), where S is the slope of the line prior to time T0 and SD is the desired slope.

Figure 8:
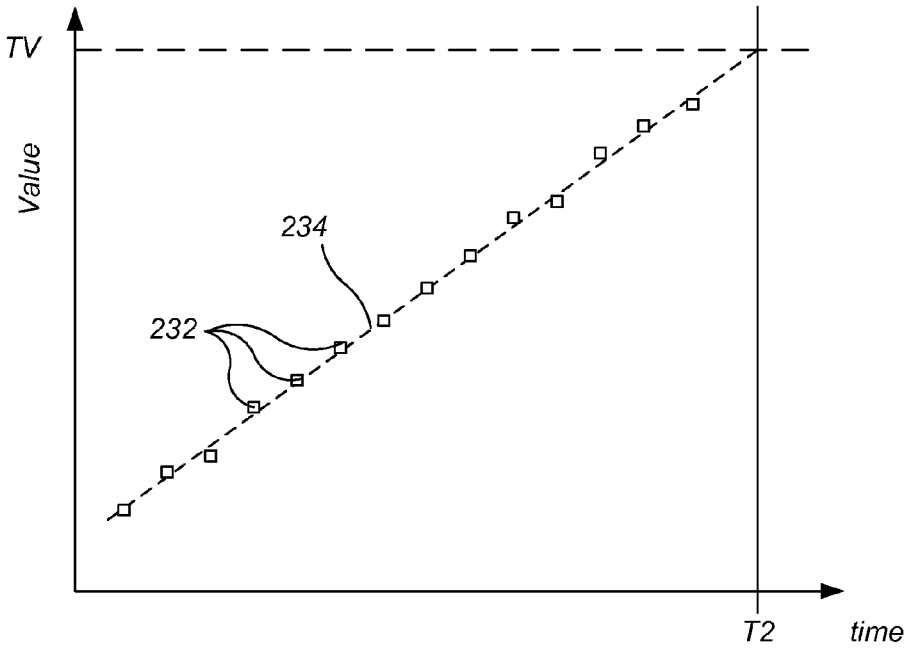
FIG. 8 illustrates a calculation of an endpoint time based on a time that a function fit to a sequence of modified values reaches a target value.

Referring to FIG. 8, in some implementations, the sequence of modified values 232 can be used to determine a polishing endpoint. In particular, endpoint can be detected as the time T2 at which the function 234 fit to the sequence 230 of modified values 232 equals a target value TV. If a polishing parameter is adjusted during the polishing operation, then the portion of the function 234 can be fit to the portion of the sequence 230 after the parameter was adjusted.

It is possible to generate a sequence of modified values for different zones of the substrate, and use the sequences from different zones to adjust the pressure applied in the chambers of the carrier head to provide more uniform polishing, e.g., using techniques described in U.S. application Ser. No. 13/096,777, incorporated herein by reference (in general, the modified value can be substituted for the index value to use similar techniques). In some implementations, the sequence of modified values is used to adjust the polishing rate of one or more zones of a substrate, but another in-situ monitoring system or technique is used to detect the polishing endpoint.

Alternatively, rather than store a sequence of default values, the controller 190 stores a default function, e.g., a default linear function. A fitted function, e.g., a linear function, is fit to the sequence of measured values. The fitted function is combined with the default function to generate a modified function. The modified function can then be used to in place of function 234.

In some implementations, if the function is a linear function, then a modified slope can be calculated as a weighted average of the slope of the default linear function and the slope of the fitted function, and a modified x-axis intersection time can calculated as a weighted average of the x-axis intersection time of the default linear function and the x-axis intersection time of the fitted function. For example, an expected endpoint time TE can be calculated from the equation TV=(W*S1+(1−W)S3)·(TE−(W*T1+(1−W)*T3)), where S1 is the slope of the fitted function, S3 is the slope of the default function, T1 is the x-axis intersection time at which the fitted line crosses a starting value, e.g., 0, T3 is the x-axis intersection time at which the default line crosses the starting value, and W is a weighting value. The weighting value W can be determined using one of the techniques discussed above.

The controller 190 can include a central processing unit (CPU) 192, a memory 194, and support circuits 196, e.g., input/output circuitry, power supplies, clock circuits, cache, and the like. In addition to receiving signals from the optical monitoring system 160 (and any other endpoint detection system 180), the controller 190 can be connected to the polishing apparatus 100 to control the polishing parameters, e.g., the various rotational rates of the platen(s) and carrier head(s) and pressure(s) applied by the carrier head. The memory is connected to the CPU 192. The memory, or computable readable medium, can be one ore more readily available memory such as random access memory (RAM), read only memory (ROM), floppy disk, hard disk, or other form of digital storage. In addition, although illustrated as a single computer, the controller 190 could be a distributed system, e.g., including multiple independently operating processors and memories.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a machine-readable storage media, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A method of controlling polishing, comprising:

storing a sequence of default values;

polishing a substrate;

monitoring the substrate during polishing with an in-situ monitoring system;

generating a sequence of measured values from measurements from the in-situ monitoring system;

combining the sequence of measured values with the sequence of default values to generate a sequence of modified values;

fitting a function to the sequence of modified values; and determining at least one of a polishing endpoint or an adjustment for a polishing rate based on the function.

2. The method of claim 1, wherein for each measured value from the sequence of measured values there is an associated default value from the sequence of default values.

3. The method of claim 2, wherein combining the sequence of measured values with the sequence of default values comprises for each measured value calculating a weighted average of the measured value and the associated default value.

4. The method of claim 3, comprising storing a first timestamp for each measured value from the sequence of measured values, and a second timestamp for each default value from the sequence of default values.

5. The method of claim 4, comprising determining a matching default value from the sequence of default values for each measured value, and wherein determining the matching default value includes determining the second timestamp that matches the first timestamp.

6. The method of claim 4, wherein the first timestamp comprises a measurement time, a number of platen rotations, or an ordinal position in the sequence of measured values.

7. The method of claim 3, comprising receiving user input selecting the weighting value for the calculation of the weighted average.

8. The method of claim 7, wherein a same weighting value is used for the calculation of the weighted average for every measured value from the sequence of measured values.

9. The method of claim 3, comprising dynamically determining a weighting value for the calculation of the weighted average.

10. The method of claim 9, wherein dynamically determining the weighting value comprises fitting a second function to the sequence of measured values, determining a goodness of fit of the second function to the sequence of measured values, and determining the weighting value based on the goodness of fit.

11. The method of claim 9, wherein monitoring the substrate comprises receiving a measured spectrum from the in-situ monitoring system, and wherein generating the sequence of measured values comprises finding a best matching reference spectrum from a plurality of reference spectra.

12. The method of claim 11, wherein dynamically determining the weighting value comprises determining a difference between the measured spectrum and the best matching reference spectrum, and determining the weighting value based on the difference.

13. The method of claim 9, wherein a same weighting value is used for the calculation of the weighted average for every measured value from the sequence of measured values.

14. The method of claim 9, comprising calculating a weighting value for each measured value.

15. The method of claim 1, wherein the in-situ monitoring comprises an optical monitoring system or an eddy current monitoring system.

16. The method of claim 1, wherein polishing the substrate comprises rotating a platen, and the sequence of measured values comprises one measured value per rotation of the platen.

17. The method of claim 1, comprising storing a target value and determining a polishing endpoint by calculating a time at which the function equals the target value.

18. The method of claim 1, comprising determining a value of the function at a time T0 at which the polishing parameter is adjusted, and wherein determining the adjustment comprises calculating a desired polishing rate based on the value of the function.

* * * * *